United States Patent [19]

Smith et al.

[11] Patent Number: 4,462,583

[45] Date of Patent: Jul. 31, 1984

[54] VARIABLE CLOTH FEED SPEED CONTROL FOR CLOTH SPREADING MACHINE

[75] Inventors: Hoyt L. Smith; D. Frank Farrar, Jr., both of Nashville, Tenn.

[73] Assignee: Cutters Exchange, Inc., Nashville, Tenn.

[21] Appl. No.: 411,877

[22] Filed: Aug. 26, 1982

[51] Int. Cl.[3] ..... B65H 29/46

[52] U.S. Cl. ..... 270/31

[58] Field of Search ..... 270/30–31; 38/143, 45, 53

[56] References Cited

U.S. PATENT DOCUMENTS

| | | | |
|---|---|---|---|
| 3,400,927 | 9/1968 | Martin, Sr. et al. | 270/31 |
| 3,663,006 | 5/1972 | Benson | 270/31 |
| 3,684,273 | 8/1972 | Benson et al. | 270/31 |
| 3,727,907 | 4/1973 | Martin, Sr. et al. | 270/31 |
| 3,782,649 | 7/1974 | Frederick et al. | 270/31 X |

FOREIGN PATENT DOCUMENTS

| | | | |
|---|---|---|---|
| 650382 | 2/1951 | United Kingdom | 270/30 |

*Primary Examiner*—E. H. Eickholt

*Attorney, Agent, or Firm*—Harrington A. Lackey

[57] ABSTRACT

A variable speed control device operatively connected between the wheel of the longitudinally movable frame of a cloth spreading machine and a cloth feed roll on the frame, including a pair of variable pitch pulleys linked by an endless belt, and a manually operable control member for simultaneously varying inversely the diameters of the pulleys in order to change the relative speed of the cloth feed roll and the linear speed of the machine frame.

The variable speed control device also includes a clutch control device for selectively engaging and disengaging the drive between the frame wheel and the cloth feed roll.

10 Claims, 7 Drawing Figures

VARIABLE CLOTH FEED SPEED CONTROL FOR CLOTH SPREADING MACHINE

BACKGROUND OF THE INVENTION

This invention relates to a cloth feed control for a cloth spreading machine, and more particularly to a variable cloth feed speed control for a cloth spreading machine.

In the operation of cloth spreading machines, longitudinally and reciprocally movable over a cutting table, and including a driven cloth feed roll for feeding a web of cloth from a cloth supply to and along the cutting table as the machine frame moves over the cutting table, the relative speed of the cloth feed and the frame movement is critical in order that the cloth may be spread upon the table and upon the preceding layers of cloth with a minimum of stretching or wrinkling.

Various types of cloth feed controls for cloth spreading machines are know in the art. Many such controls utilize dancer rolls or other sensors for detection of slack loops of cloth, or the cloth feed speed is corrected by manual adjustment during the progress of the cloth spreading operation. These various detection and control methods actuate electrical motors or motor controls to stop and start the cloth feed when desired, or vary the electrical resistance in a motor speed control in order to continually change the speed of the cloth feed roll, so that it conforms with the linear speed of the machine frame.

Examples of some of the prior art cloth feed control mechanisms are disclosed in the following U.S. patents:

| | | |
|---|---|---|
| 3,400,927 | Martin Sr., et al | Sept. 10, 1968 |
| 3,663,006 | Benson et al | May 16, 1972 |
| 3,684,273 | Benson et al | Aug. 15, 1972 |
| 3,727,907 | Martin Sr., et al | April 17, 1973 |
| 3,782,649 | Frederick et al | Jan. 1, 1974 |

SUMMARY OF THE INVENTION

In order to provide a gradual and infinitely adjustable system for controlling the relative speed of the cloth web and the spreading machine frame, the variable cloth feed speed control device made in accordance with this invention includes a system of mechanical elements which may be finely adjusted manually by the operator as the machine moves along the cutting table.

Specifically, the speed control device made in accordance with this invention includes a pair of variable pitch pulleys, an input pulley and an output pulley, linked by an endless belt. The shaft of the input pulley is coupled through a drive transmission, such as a sprocket and chain transmission, to one of the wheels of the frame so that as the frame moves longitudinally over the cutting table, the drive from the wheel is transmitted to the input shaft of the input pulley. The shaft of the output pulley is connected through an output drive transmission to the cloth feed roll.

An elongated speed control shaft has a first screw feed mechanism connected to the axially movable flange of the output pulley so that rotation of the control shaft causes the flange to move toward or away from the output pulley, depending upon the direction of rotation of the control shaft. The axially movable flange of the input pulley is also connected to a second screw feed mechanism, which in turn is linked by a transmission, such as a gear transmission, to the control shaft, so that the rotation of the control shaft in one direction to axially shift the output pulley flange toward the belt, will simultaneously cause the axially movable flange of the input pulley to move away from the belt, and vice versa. By virtue of this control mechanism, the flanges of the input and output pulleys can be varied incrementally in opposite directions for very fine adjustments of the relative speed between the machine frame and the cloth feed roll.

A second control shaft is provided for axial movement to axially shift a clutch member along the output pulley shaft for operative engagement or disengagement with a corresponding clutch face on a freely rotary driven member, such as a sprocket, on the output pulley shaft, in order to selectively connect the cloth feed roll drive to the input drive produced by the movement of the machine frame.

DESCRIPTION OF THE PREFERRED EMBODIMENTS

Figures 1, 5, 6, 7:
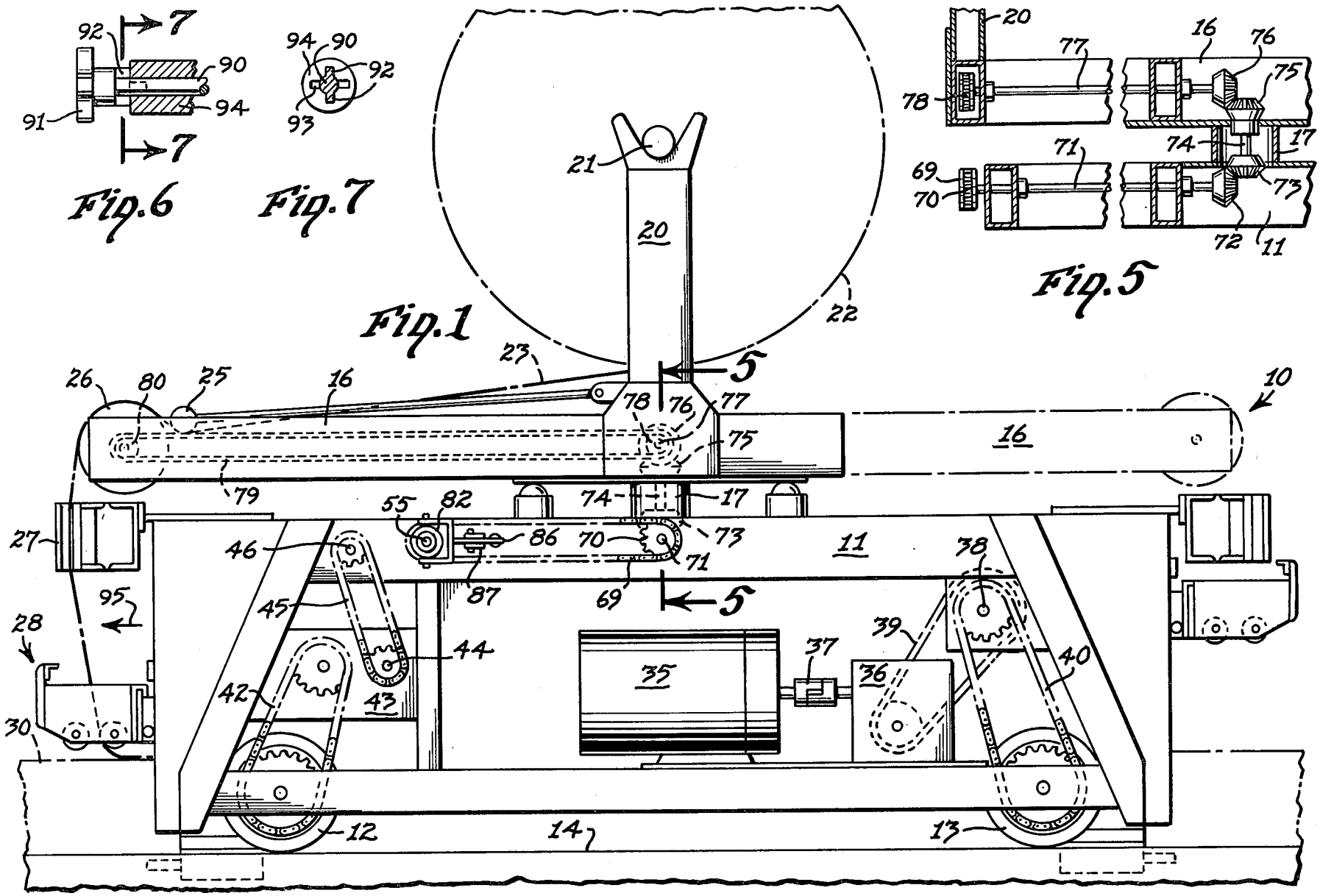
FIG. 1 is a side elevation of a cloth spreading machine including a variable cloth feed speed control apparatus made in accordance with this invention.
FIG. 5 is a fragmentary section, taken along the line 5—5 of FIG. 1, with portions broken away.
FIG. 6 is a fragmentary section, taken along the line 6—6 of FIG. 3.
FIG. 7 is a section, taken along the line 7—7 of FIG. 6.
Figures 2, 3, 4:
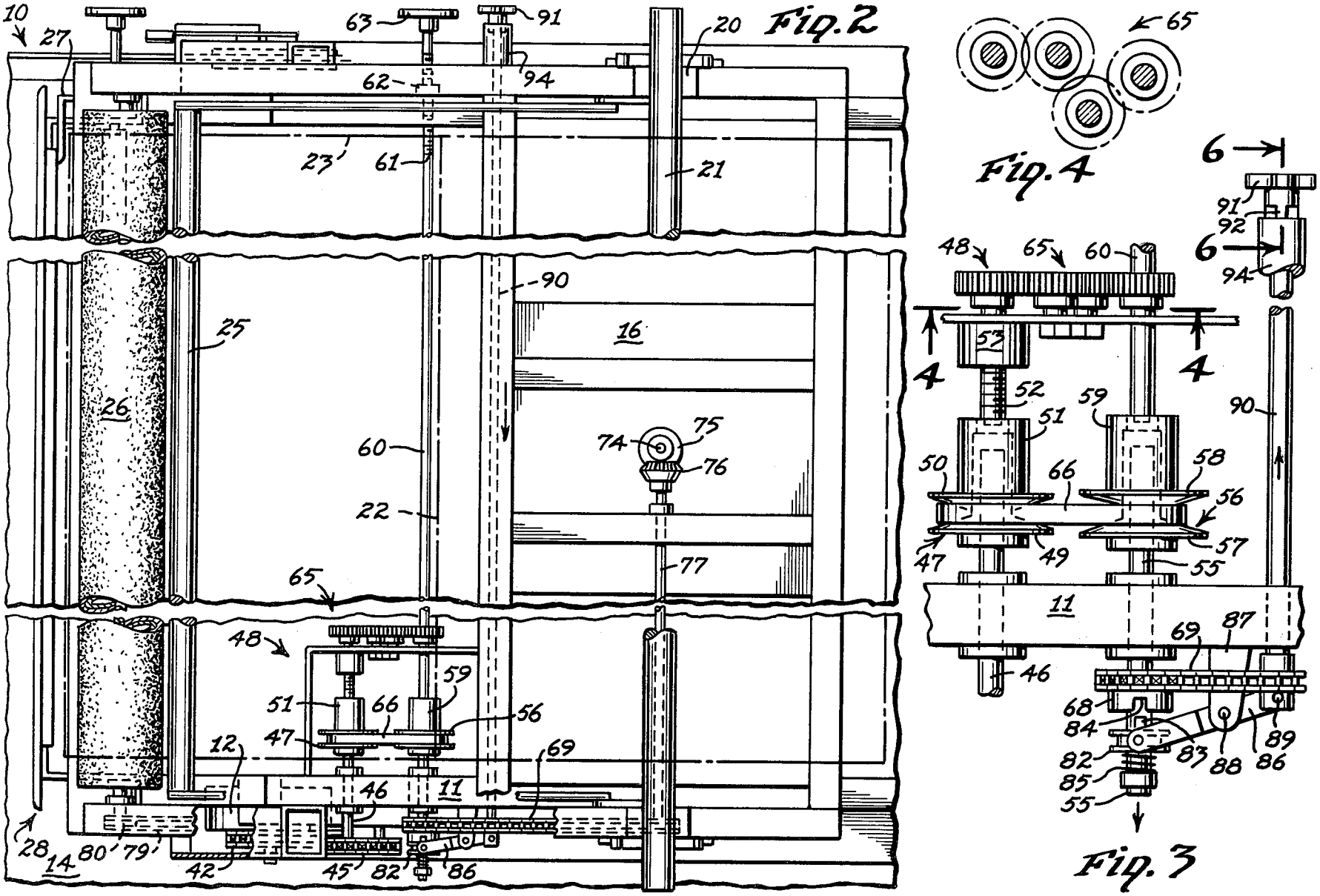
FIG. 2 is a fragmentary top plan view of the cloth spreading machine disclosed in FIG. 1, with portions broken away.
FIG. 3 is an enlarged fragmentary plan view of the cloth feed speed control apparatus, with portions broken away.
FIG. 4 is a schematic section, taken along the line 4—4 of FIG. 3, disclosing the gear train arrangement.

Referring now to the drawings in more detail, FIGS. 1 and 2 disclose a cloth spreading machine 10 including a frame or machine 11 supported by wheels, such as the smooth-surfaced wheels 12 and 13 on the remote side of the frame 11, shown in FIG. 1, for rolling movement over the top surface of a spreading or cutting table 14.

Mounted on top of the machine frame 11 is a cloth supply carriage 16 in the form of a turntable mounted for rotary movement about the vertical axis of the hollow shaft 17.

Mounted at opposite sides of the carriage 16 are a pair of cloth roll support standards 20, which support a spindle 21 upon which is wound a cloth supply roll 22.

From the cloth supply roll 22 a web of cloth 23 passes beneath a transverse guide bar 25, over a cloth feed roll 26 mounted on one end of the carriage 16, and then down through an edge sensor 27 and through a conventional spreader unit 28. The spreader unit 28 spreads or lays the web 23 upon the surface of the cutting table 14 in layers 30 (FIG. 1), as the machine frame 11 reciprocates longitudinally on a predetermined course over the cutting table 14.

As best disclosed in FIG. 1, an electrical motor 35 may be mounted on a machine frame 11 to drive a gear reducer 36, through shaft coupling 37. The rear reducer 36 drives the wheel drive shaft 38 through sprocket and chain transmission 39. Power from the wheel drive shaft 38 is transmitted to the wheel 13 through sprocket and chain transmission 40. The electrical motor 35 may be provided with power from any convenient source, not shown, and controlled in any conventional manner.

The front wheel 12 is operatively connected by a chain and sprocket transmission 42 to a direction compensator or unidirectional gear box 43. Thus, regardless of the direction of rotation of the front wheel 12, the gearing and transmission within the unidirectional gear box 43 will produce the unidirectional rotary output. In other words, the rotary output shaft 44 on the unidirectional gear box 43 will always rotate in the same direction, regardless of the rotary direction of the wheel 12. However, the rotary speed of the output shaft 44 will be commensurate or proportional to the speed of the table wheel 12. The unidirectional output shaft 44 is connected through a sprocket and chain transmission 45 to the input shaft 46 of an input variable pitch pulley 47 in the variable speed control device 48, made in accordance with this invention.

The variable pitch input pulley 47 has a V-shaped groove defined by a fixed flange 49 and an axially shiftable flange 50. The axially shiftable flange 50 is fixed to the hub 51 rotatably coupled to a screw feed shaft 52, which is threaded for axial movement within a fixed screw feed housing 53.

The variable speed control device 48 includes an output shaft 55 fixed to a variable pitch output pulley 56 including a fixed flange 57 and an axially shiftable flange 58 defining an annular V-shaped groove of variable diameter. The axially shiftable flange 58 is fixed to a hub 59, which is rotatably coupled to an elongated speed control shaft 60, extending the full width of the machine frame 11. The control shaft 60 has a threaded portion 61 threadedly engaging a nut member 62 on the operator side of the machine 10 to provide axial feeding movement of the control shaft 60 in either axial direction. The extremity of the control shaft 60 is provided with a handle 63 for manually rotating the shaft 60 in either rotary direction.

The control shaft 60 is rotatably linked to the screw feed shaft 52 through the gear train 65, including four intermeshing spur gears, as illustrated in FIGS. 3 and 4. The left spur gear in the train 65 in FIG. 3 is fixed to the screw feed shaft 52 to move axially therewith. However, the axial travel of the left spur gear is so limited, that it always remains enmeshed with the next cooperating spur gear in the gear train 65. In like manner, the right spur gear in FIG. 3 moves axially with the control shaft 60, without losing meshing engagement with the adjacent cooperating spur gear in the gear train 65.

Thus, when the handle 63 is rotated in one direction, the screw feed shaft 52 is rotated in the opposite direction to simultaneously cause the axially movable flanges 58 and 50 to shift axially in opposite directions, thus increasing the diameter of one of the pulleys 47 or 56, while decreasing the diameter of the other pulley 56 or 47. The pulleys 47 and 56 are linked by an endless belt 66.

Of course, when the control shaft 60 is counter-rotated in the opposite direction, the screw feed shaft 52 will be rotated in the reverse direction, which is the direction opposite to the rotation of the control shaft 60, in order to reverse the directions of axial movement of the shiftable pulley flanges 50 and 58.

Carried on the outer portion of the output shaft 55 for free rotatable movement is a clutch sprocket 68 carrying a chain 69 trained about the sprocket 70 fixed to shaft 71 extending transversely of, and journaled for rotary movement in, the frame 11. The inner end of the shaft 71 terminates in a bevel gear 72 meshing with another bevel or miter gear 73 disposed at right angles and fixed to a vertical rotary shaft 74 within the hollow turntable shaft 17. The rotary shaft 74 terminates at its upper end in in another bevel or miter gear 75. The bevel gear 75 meshes with bevel gear 76 fixed at the inner end of another transverse shaft 77, journaled in the turntable carriage 16, and terminating at its outer end in a sprocket 78. The sprocket 78 is coupled through chain 79 to sprocket 80 fixed to the shaft of the driven cloth feed roll 26. Thus, through this drive transmission from the output shaft 55 to the cloth feed roll 26, the drive is uninterrupted, even through the turntable 16 is rotated about its vertical axis relative to the machine frame 11 to position the cloth feed roll 26 optionally at either end of the cloth spreading frame 11.

In order to selectively engage and disengage the drive for the cloth spreading frame 11 and the cloth feed roll 26, a clutch disc 82 is axially slidable, but rotatably fixed, on the outer end of the output shaft 55 of the variable speed control device 48. The clutch disc 82 is provided with an axially projecting tongue or lug 83 which is adapted to engage a corresponding recess 84 in the clutch sprocket 68, when the clutch disc 82 is thrust axially inwardly along the output shaft 55 by a spring 85.

The clutch disc 85 is pivotally connected to a link arm 86, the intermediate portion of which is pivoted to a fixed bracket 87 on the machine frame 11 by a pivot pin 88. The opposite or rear end portion of the link arm 86 is pivotally connected by pin 89 to a transversely extending, and axially shiftable, clutch control rod or shaft 90. The clutch control rod 90 extends the full width of the machine frame 11, projecting from the operator's side of the frame 11 and terminating in a clutch control knob or handle 91. When the control knob 91 is pulled outboard of the machine frame 11 by the operator, the clutch disc 82 is shifted axially outboard on the opposite side of the machine frame 11 to disengage the clutch tongue 83 from the recess 84 to disengage the drive transmission between the motor 35 and the cloth feed roll 26.

The manual control knob 91 may be retained in its outboard position by rotation of the knob 91 through a predetermined angle so that the diametrical ears 92 will be rotated out of registry with a corresponding pair of recesses 93 in a journal housing 94 for the clutch control rod 90, as best illustrated in FIGS. 6 and 7. By counter-rotating the knob 91 so that the ears 92 will register with the recesses 93, the handle 91 may be released to permit the spring 85 to thrust the clutch disc 82 back into driving engagement with the clutch sprocket 68.

In the operation of the cloth spreading machine 10, the machine frame 11 is driven over the cutting table 14 in a direction, such as the forward direction indicated by the arrow 95 in FIG. 1, by energization of the motor 35. As the machine frame 11 is moving along the table 14, the front wheel 12 is rotated to cause the variable pulleys 47 and 56 to rotate in a direction for driving the cloth feed roll 26 to feed the cloth web 23 down toward the table 14 for spreading, when the clutch disc 82 engages the clutch sprocket 84, as illustrated in FIG. 2.

If the cloth web 23 is being fed too fast relative to the table speed of the machine frame 11, then the operator walking alongside the machine 10 grasps the control shaft handle 63 and rotates it in a direction which will cause the opposite axial shiftable movement of the pulley flanges 50 and 58, which will reduce the speed of the cloth feed roll 26.

If the cloth 23 is being fed too slowly, then the control shaft handle 63 will be rotated in the opposite direction until the speed of the cloth will be commensurate with the speed of the machine frame, so that the cloth web 23 will be laid flat on the cutting table 14, or on the next subjacent layer of cloth in the stack 30 on the cutting table 14, without tension or slack.

Because of the construction of the variable speed control device 48, including the screw-feed structure 61–62 of the control shaft 60 and the screw feed shaft 52, the axial opposite shifting of the flanges 50 and 58 can be carried out incrementally with very fine adjustments.

These adjustments may be made regardless of the position of the cloth feed roll 26, that is whether the cloth feed roll 26 is spreading on the front end of the frame 11 or whether it has been rotated about the shaft 74 through 180° for spreading cloth at the rear end of the frame 11.

Moreover, at any time when it is desired to move the spreading frame 11 without spreading cloth, the operator may withdraw the clutch control knob 91 outboard to disengage the clutch disc 82 from the clutch sprocket 84.

What is claimed is:

1. In a cloth spreading machine having a longitudinally movable frame and a driven cloth feed roll on the frame, a variable cloth feed speed control means comprising:

(a) an input pulley having a variable pitch, (b) an output pulley having a variable pitch, (c) belt means drivably engaging said input and output pulleys, (d) input drive means operatively connected to said input pulley to rotate said input pulley at a rotary speed proportional to the linear speed of the movable cloth spreading machine frame, (e) output drive means operatively connected to said output pulley and the cloth feed roll to rotate the cloth feed roll at a speed proportional to the rotary speed of said output pulley, and (f) control means for varying the pitches of said input and output pulleys in order to vary the relative speeds of the machine frame and the cloth feed roll.

2. The invention according to claim 1 in which each of said first and second pulleys has an axially movable flange for varying the diameter of each of said respective pulleys, said control means comprising means for simultaneously axially shifting the movable flanges of both pulleys in opposite axial directions.

3. The invention according to claim 2 in which said control means comprises an axially movable control rod operatively connected to one of said movable pulley flanges, first threaded feed means, operatively associated with said control rod, whereby rotation of said control rod in one direction moves said movable pulley flange toward the opposite flange of said corresponding pulley, and counter-rotation of said control rod moves said movable flange away from the opposite flange of said pulley, second threaded feed means for axially shifting the movable flange of said other pulley, and coupling means operatively connecting said control rod and said second threaded feed means for shifting said movable flanges simultaneously in opposite axial directions from each other when said conrol is rotated in either direction.

4. The invention according to claim 3 in which said coupling means comprises a gear train.

5. The invention according to claim 1 in which said output pulley is mounted on an output shaft and said output drive means comprises a rotary driven member freely rotatable on said output shaft, transmission means coupling said rotary driven member to the cloth feed roll for driving the cloth feed roll when the rotary driven member is driven, clutch means on said output pulley shaft for operative engagement and disengagement with said rotary driven member, and manual clutch control means operatively connected to said clutch means for causing said clutch means to selectively engage or disengage said rotary driven member.

6. The invention according to claim 5 in which said clutch control means comprises an axially shiftable elongated clutch rod, said clutch means comprising a first clutch face axially shiftable upon said output shaft, a second clutch face on said rotary driven member, and means coupling said clutch control rod to said first clutch face for axially moving said first clutch face into and out of engagement with said second clutch face, in order to selectively drive said cloth feed roll.

7. The invention according to claim 6 in which said clutch control rod extends transversely of the machine frame and said output shaft extends transversely of the machine frame, one end of said clutch control rod having a handle and the opposite end of said clutch control rod being a free end portion, a link bar pivotally connected to the machine frame and having opposite first and second ends, the first end being connected to the free end portion of the clutch control rod and the second end of the link bar being connected to said first clutch face.

8. The invention according to claim 7 in which said handle of the clutch control rod is freely rotatably mounted on the end of said clutch control rod, a latch member on said rotary handle, and a latch keeper adjacent said control handle, whereby rotation of said control handle to a latching position causes said latch to engage said keeper with said clutch control rod being in an inoperative position in which said first clutch face disengages said second clutch face in order to disconnect the drive between the movable spreader frame and the cloth feed roll.

9. The invention according to claim 1 in which said input drive means comprises an input shaft fixed to said input pulley for rotary movement therewith, the movable frame having a wheel for rotary movement over the cutting table, said input drive means further comprising transmission means between said wheel and said input drive shaft for rotating said input pulley at a speed commensurate with the rotary speed of the wheel of the frame.

10. The invention according to claim 1 in which said output drive means comprises an output shaft fixed to said output pulley for rotary movement therewith, and transmission means coupling said output shaft with said cloth feed roll for driving said cloth feed roll at a speed proportional to the rotary speed of said output pulley.

* * * * *